United States Patent [19]

Heimer et al.

[11] Patent Number: 4,480,410

[45] Date of Patent: Nov. 6, 1984

[54] PRECISION CENTER LAPPING APPARATUS AND METHOD

[75] Inventors: Robbin Heimer, Mesa; Thomas C. Shepard, Phoenix; Peter F. Lucier, Mesa, all of Ariz.

[73] Assignee: Cen-T-Lap Corp., Phoenix, Ariz.

[21] Appl. No.: 418,280

[22] Filed: Sep. 15, 1982

[51] Int. Cl.[3] ..... B24B 9/00

[52] U.S. Cl. ..... 51/5 D; 51/325; 125/11 B

[58] Field of Search ..... 51/5 R, 5 D, 72 R, 34 H, 51/260, 103 C, 67, 98 R, 125, 325; 125/38, 39, 11 B

[56] References Cited

U.S. PATENT DOCUMENTS

| | | | |
|---|---|---|---|
| 2,436,605 | 2/1948 | Robins | 51/72 R |
| 3,576,184 | 4/1971 | Nichols | 125/11 B |
| 4,006,727 | 2/1977 | Hancock | 125/11 B |

OTHER PUBLICATIONS

"Ex-Cell-O Center Lapping Machines," Bulletin No. 40271, Ex-Cell-O Corporation, Detroit, Mich.

*Primary Examiner*—Frederick R. Schmidt
*Assistant Examiner*—Matthew D. Daschel
*Attorney, Agent, or Firm*—Cahill, Sutton & Thomas

[57] ABSTRACT

A center lapping apparatus for precisely lapping center holes in opposite ends of the workpiece prior to outside diameter grinding of the workpiece includes a conical lapping stone and a dressing apparatus that supports a dressing stone for periodically dressing the lapping stone. Movement of the dressing stone during any dressing operation is confined to a plane in which an axis of symmetry of the lapping stone lies. A spring loaded pin disposed in a movable head of the dressing apparatus has a slightly tapered end which precisely fits in a stationary hole of a mounting bracket about which the movable head pivots. The tapered end of the spring loaded pin ensures that the dressing stone can always be returned to precisely the same position for a dressing operation despite wear of the spring loaded pin. A precise flat surface of the moveable head slides against a precision flat surface of the stationary plate during pivoting of the movable head. The flat surfaces are parallel to the plane in which movement of the dressing stone is confined.

3 Claims, 7 Drawing Figures

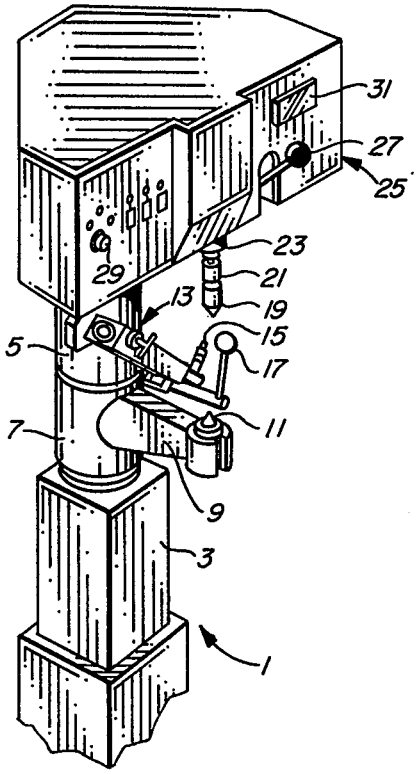
FIG. 1
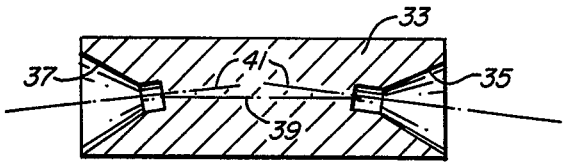
FIG. 2A
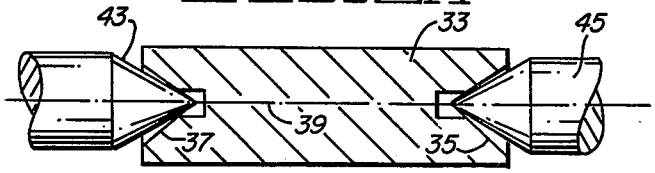
FIG. 2B
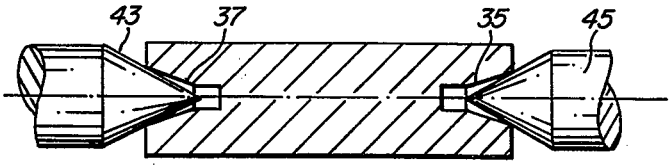
FIG. 2C
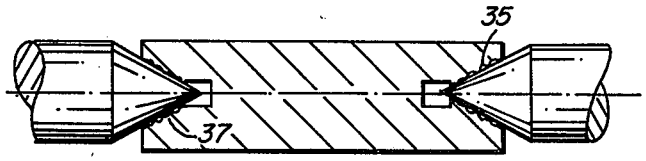
FIG. 2D
FIG. 2E
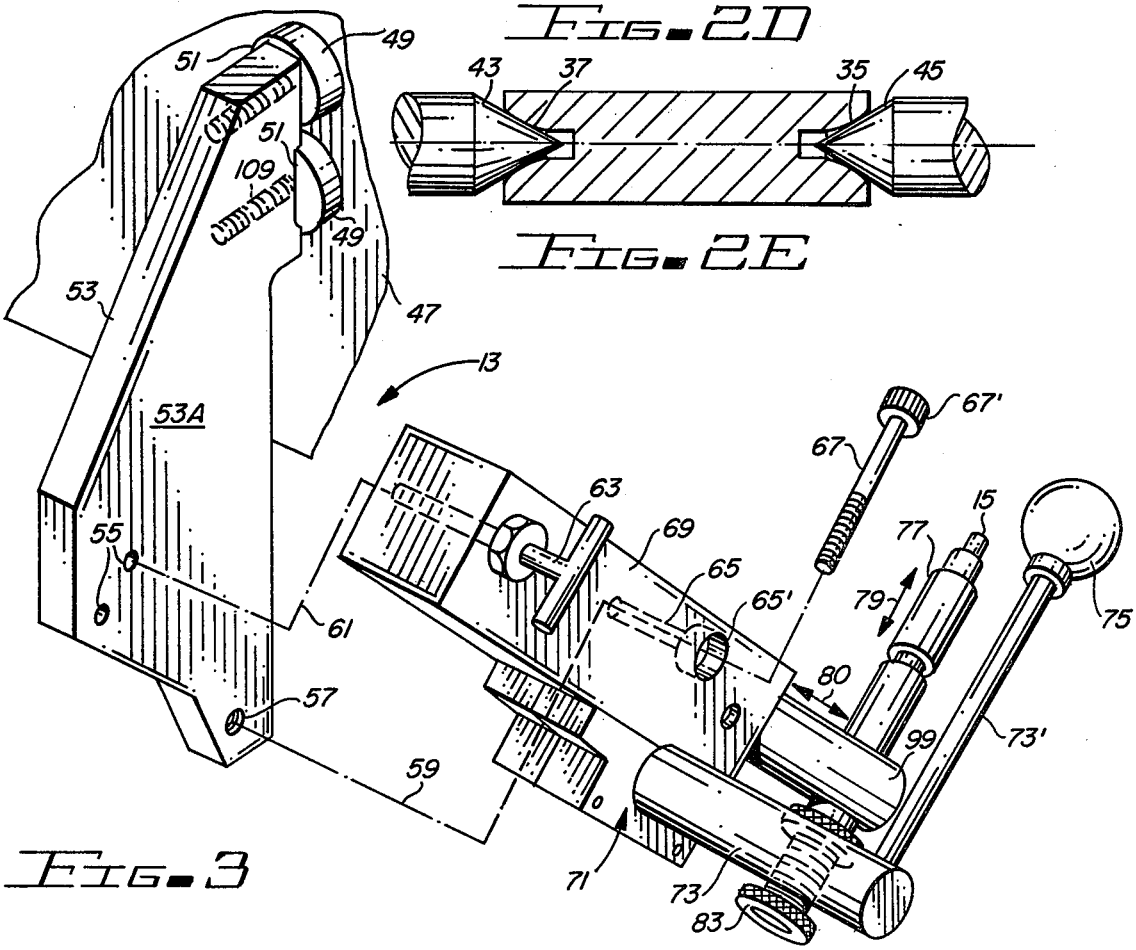
FIG. 3

FIG. 4
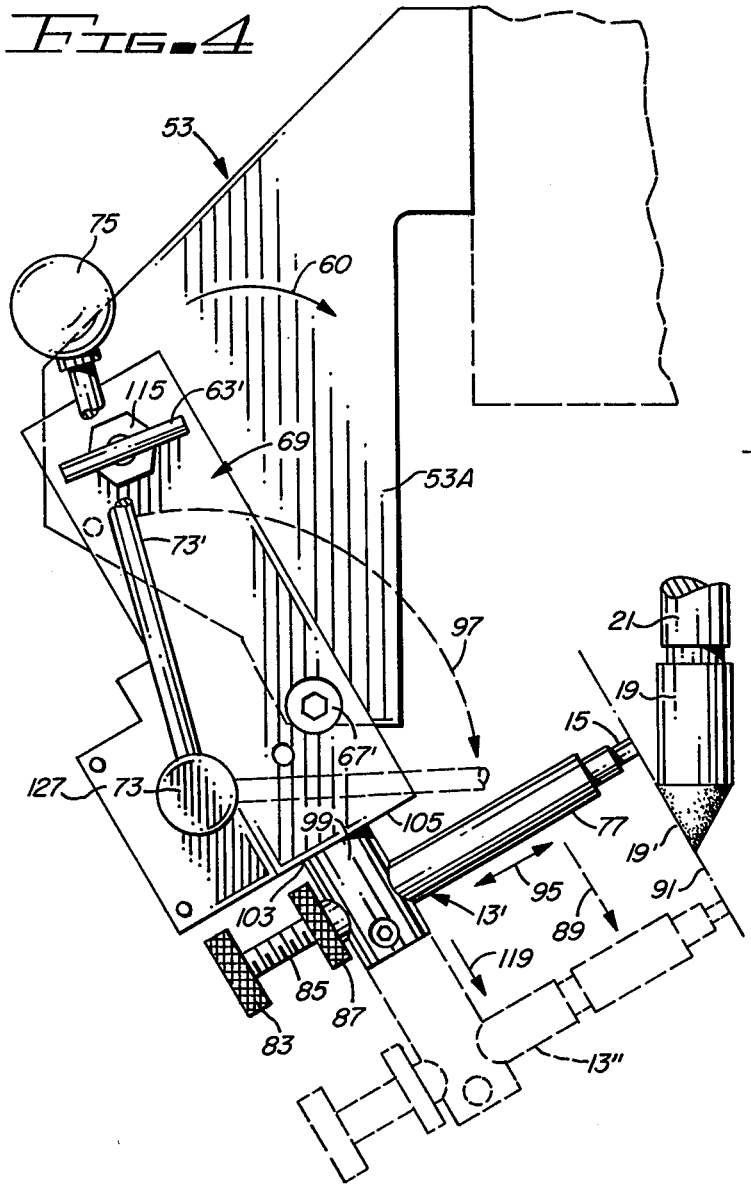
FIG. 5
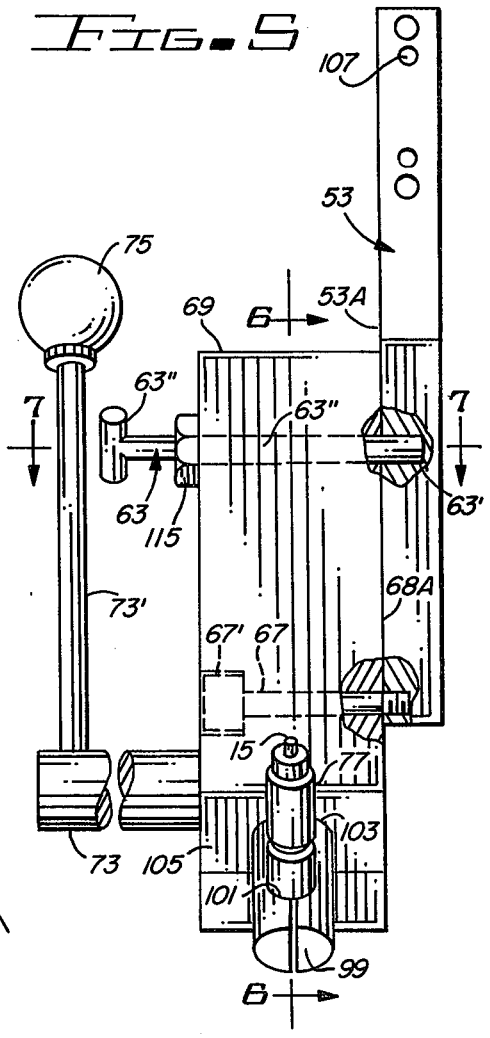
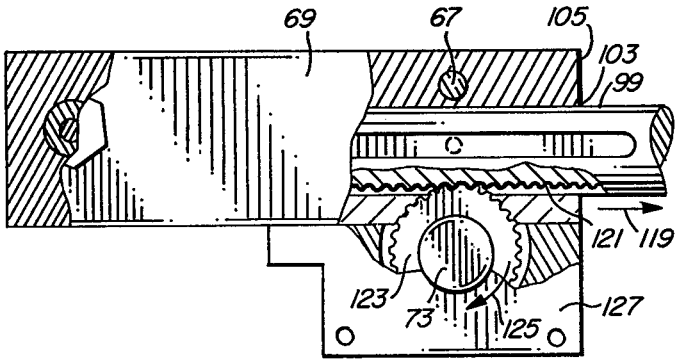
FIG. 6
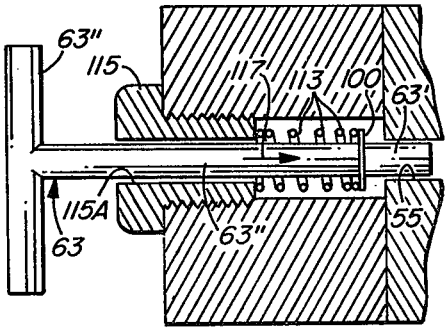
FIG. 7

PRECISION CENTER LAPPING APPARATUS AND METHOD

BACKGROUND OF THE INVENTION

The invention relates to center lapping tools for precisely lapping center holes of opposed ends of a workpiece in order to facilitate subsequent high precision "inside diameter outside diameter", or ID/OD, grinding of the workpiece.

It is well known to those in the machine tool business that extremely close tolerances need to be maintained during an operation known as "between-centers grinding". In "between-centers grinding" operations, a cylindrical workpiece is supported by means of "center holes" disposed in opposite ends of the workpiece. The center holes of the workpiece ordinarily originally are provided therein by means of a lathe. One end of the workpiece is positioned in the jaws of the lathe, and a center drill is used to drill one center hole in the opposed end of the workpiece. The workpiece is then removed from the jaws of the lathe chuck and reversed, and the procedure is repeated to cut the second center hole in the other end of the workpiece. Unfortunately, it is very difficult to achieve the desired accuracy in alignment of the two center holes formed in this manner. Furthermore, the roundness of such center holes is not as accurate as is sometimes needed. Cylindrical workpieces with lathe-cut center holes often are heat treated before the between-centers grinding operation, and this usually results in some warpage, which misaligns the lathe-cut center holes, even if they initially are perfectly aligned and perfectly round. In order to solve this problem, a prior art machine made by EX-CEL-O Corporation of 549 Cedar Street, Newington, Conn. 06111, known as a "center lapping machine" was devised many years ago and remains the only such machine that is commonly used. This center lapping machine includes a stationary, rigidly supported, upwardly oriented conical support, referred to herein as a "dead center" cone coaxially disposed with a rotary conical grinding stone that is commonly referred to as a "lapping stone" mounted on a motor driven spindle. This spindle is driven by a belt and pulleys, and has four speeds which can be varied only by changing a belt and pulleys. The lapping stone can be "dressed" by means of a built-in dressing tool that is pivotal by means of a gate-like hinge mechanism to swing a diamond dressing tip adjacent to the rotary lapping stone. The diamond tip point can be moved along the surface of the rotating lapping stone, trimming it precisely to the proper angle, removing any buildup of material that may have occurred. To continue center lapping operations, the dressing tool is pivoted away from the lapping stone. The user positions one end of a workpiece to be center lapped so that the tip of the dead center cone is inserted into that center hole. The operator then lowers the spindle on which the lapping stone is supported into the upper center hole, and lightly grinds the workpiece material surrounding the upper center hole, thereby producing a new, cleanly lapped, precisely oriented center hole. The workpiece is then inverted. and the same operation is repeated to lap the other center hole.

Although the EX-CEL-O center lapping machine has been the "industry standard" for many years, it suffers from a number of shortcomings. One is that the dressing tool mechanism does not always provide the extremely precise accuracy necessary to always dress the lapping stone as accurately as is needed. This problem is especially pronounced for older machines, due to the wear in the hinge mechanism and the failure of the dressing mechanism to return to precisely the same dressing position every time it is used. Other problems with this prior art center lapping machine include the necessity of a time consuming belt changing operation to attain one speed which is satisfactory for dressing a particular stone and another spindle speed which is necessary for center lapping a particular type of workpiece with that dressed lapping stone. This operation sometimes must be repeated every time the lapping stone is dressed, which may be as often as every dozen or so center lapping operations, since hard metal workpieces rapidly deteriorate the grinding surface of even the hardest lapping stone. The time required to change spindle speeds by carrying out a belt changing operation greatly reduces the efficiency of the machinists in carrying out the between centers grinding operations. In modern applications, required tolerances for between centers grinding in the aircraft turbine industry range from vary one ten-thousandth to a millionth of an inch. These tolerances cannot be maintained on a high yield basis without excess use of high cost machinist's time with the above described prior art center lapping machine. Furthermore, some lapping stones have cone angles other than the sixty degree angle, which is the only dressing angle capable of being utilized by the prior art center lapping machine.

Thus, there is an unmet need for an improved center lapping machine which is capable of consistently producing extremely high precision, precisely aligned center holes in workpieces to allow extremely precise between centers grinding operations to be performed on the workpieces.

Accordingly, it is an object of the invention to provide an improved center lapping machine and method for providing extremely precise dressing of lapping stones with an extremely high degree of repeatability.

It is another object of the invention to provide an improved center lapping machine which avoids excessive inconvenience and waste of time by the operator in changing spindle speeds from an optimum dressing speed to an optimum center lapping speed.

It is another object of the invention to provide an improved center lapping machine and method which avoids inaccuracy in dressing of a lapping stone due to failure of the dressing mechanism to always return to precisely the same position for each dressing operation.

It is another object of the invention to provide an improved center lapping machine that avoids inaccuracy in the center lapping operation due to slight misalignment of the dead center cone.

It is another object of the invention to provide an improved center lapping machine which precisely and conveniently can dress a plurality of lapping stones having different cone angles.

SUMMARY OF THE INVENTION

Briefly described, and in accordance with one embodiment thereof, the invention provides an improved center lapping machine and method for repeatably and precisely "dressing" a rotary lapping stone with an extremely high degree of accuracy by confining the movement of a diamond "dressing" stone to a first plane, in which a symmetrical axis of the lapping stone lies, both during a dressing operation and during pivoting of a "dressing assembly" away from the lapping stone to allow subsequent center lapping operations to be performed on a workpiece having imprecise center holes therein. In the described embodiment of the invention, the diamond dressing stone is supported on an elongated head that is mounted on a pivotal base. The pivotal base is pivotally mounted on a stationary support member. The pivotal base pivots about a first axis from a standby position to a first fixed "dressing position". The first axis is perpendicular to the symmetrical axis of the lapping stone when the lapping stone is held in a tool holder positioned in a spindle. The elongated head has a longitudinal axis that is perpendicular to the surface of the lapping stone when the pivotal base is in the first dressing position. A micrometer adjustment mechanism moves the dressing stone along the longitudinal axis of the elongated head to a position that will cause the diamond dressing stone to precisely dress the rotary dressing stone to an exact conical configuration during the performance of a dressing operation. A rack and pinion mechanism connected to the pivotal base and the elongated head can be actuated by means of a lever connected to the pinion gear to move the elongated head in a direction that is essentially parallel to the surface of the lapping stone contacted by the diamond dressing stone so that the diamond dressing stone moves in the above-mentioned first plane during a lapping operation, causing the dressing stone to precisely dress the lapping stone. In the described embodiment of the invention the support member is attached in fixed relationship to a larger support frame that also supports a variable speed motor, a spindle assembly that supports the chuck in which the lapping stone is held and to a dead center cone. The support member has a flat surface that is parallel to the first plane and the pivotal base also has a flat surface which abuts and moves in slidable relationship to the flat surface of the support member to maintain the movement of the dressing stone in the first plane. A spring loaded movable pin is journaled in the pivotal base and has a slightly tapered precision end that tightly engages any selected one of a plurality of precision holes in the flat surface of the support member. Each of the precision holes corresponds to a different cone angle of a different respective lapping stone. The tapered end of the movable pin always tightly fits into a selected one of the holes with a high degree of accuracy, despite wear of the walls of the holes, ensuring high accuracy in dressing lapping stones over a long period of time. In the described embodiment of the invention, a precision, between-centers vertical cylindrical column precisely supports a vertically adjustable support for the dead center cone so that the symmetrical axis of the dead center cone is always very precisely aligned with the symmetrical axis of the lapping stone held in the jaws of the tool holder in the chuck of the spindle.

BRIEF DESCRIPTION OF THE DRAWINGS

FIG. 1 is a partial perspective view of the upper portion of the center lapping machine of the present invention.

FIGS. 2A–2E are section diagrams useful in illustrating the types of inaccuracies and center holes correctable by the center lapping machine of the present invention.

FIG. 3 is a partial perspective exploded view of the dressing mechanism of the center lapping machine of FIG. 1.

FIG. 4 is a side view of the dressing mechanism shown in FIG. 3.

FIG. 5 is a front view of the dressing mechanism shown in FIG. 4.

FIG. 6 is a section view taken along section line 6—6 of FIG. 5.

FIG. 7 is a section view taken along section line 7—7 of FIG. 5.

DESCRIPTION OF THE INVENTION

Referring now to the drawings, particularly FIG. 1, center lapping machine 1 includes a column 3 (partly shown) on which a precision cylindrical column 5 is supported. A continuously variable speed motor, drive, and spindle mechanism 25 is rigidly supported at the upper end of column 5. A precision collar 7, which can be vertically positioned on column 5, has a horizontal arm 9. A precision conical upwardly oriented dead center cone 11 is supported on the outer end of arm 9. As subsequently described, the pointed end of dead center cone 11 is inserted into the lower center hole of a workpiece (such as 33 of FIGS. 2A–E) which is to be center lapped.

A dressing mechanism 13 is rigidly connected to the upper end of "head" 47 (FIG. 3) of the center lapping machine 1. A diamond dressing stone 15 is rigidly attached to a portion of dressing mechanism 13, subsequently described in detail. Spindle 23 has attached thereto a tool holder 21 into which a conventional commercially available cone-shaped abrasive lapping stone 19 can be mounted. A handle 27 can be pulled downward to lower spindle 23 and lapping stone 19 into the upper center hole of the above-mentioned workpiece in order to allow it to be precisely center lapped. Reference numeral 29 in FIG. 1 designates a variable-position dial that continuously controls the speed of spindle 23. Reference numeral 31 represents a digital read out indicating the spindle speed.

In FIG. 2A–2E, a cylindrical workpiece 33 is disclosed having two imprecise, and/or improperly aligned center holes 35 and 37 disposed, respectively, in the opposite ends of workpiece 33. In FIG. 2A, reference numeral 39 represents the ideal geometrically symmetric axis of workpiece 33. Reference numeral 41 represents the respective misaligned axis of center holes 35 and 37. For purposes of explanation and illustration, the imperfections and misalignments of the center holes as illustrated in FIGS. 2A–2E are greatly exaggerated. The purpose of the center lap machine is to quickly and extremely precisely lap the center holes 35 and 37 to correct the center holes' imperfections and misalignments so that the axis 41 coincides with the axis 39 and so that the lapped surfaces of those center holes are extremely smooth and perfectly round. Only then can extremely high tolerances be maintained in the workpiece 33 during a subsequent between-centers grinding operation.

FIG. 2B illustrates the situation in which workpiece 33 has been positioned between two precision cone-shaped centers of a precision "OD (outside diameter) grinder".

It can be seen that the angle subtended by the center holes 35 and 37 is too wide for the conical points of cone-shaped end support elements 43 and 45. This situation can prevent the desired tolerance from being maintained during between centers machining of workpiece 33.

FIG. 2C discloses the opposite situation, wherein the angle subtended by the walls of center holes 35 and 37 is too small for the conical tips of elements 43 and 45. Again, this situation can prevent the desired tolerances from being maintained for between centers grinding of workpiece 33. FIG. 2D discloses the situation in which the walls of center holes 35 and 37 are not smooth. This condition also can lead to failure to maintain the desired tolerance during a between centers grinding operation. Finally, FIG. 2E discloses yet another situation in which the walls of center holes 35 and 37 are somewhat convex and do not mate precisely with the conical tips of members 43 and 45. All of the conditions disclosed in FIGS. 2A–2E, and also the condition in which the center holes 35 and 37 are not perfectly round, can prevent the desired level of accuracy in being achieved in a between centers grind operation. These imperfections need to be corrected more precisely than can be conveniently accomplished by means of the prior art center lapping machine.

With these considerations in mind, the structure of the center lapping machine of the present invention will be more fully described with reference to FIGS. 3–7. Dressing assembly 13 includes a stationary support member 53, the upper end of which is rigidly attached by means of bolts 109 (FIG. 3) into a pair of precision slotted mounting discs 49 with precision slots 51 therein. Mounting discs 49 are rigidly attached to head 47, which is rigidly positioned on the top of column 5. Support member or plate 53 has a flat precision machined surface 53A, in which a plurality of precisely positioned holes 55 are disposed. The different holes 55 correspond to the possible cone angles of the lapping stone to be dressed. At the bottom portion of support member 53 is a threaded hole 57.

A pivotal base 69 is pivotally connected to stationary plate 53 by means of a bolt 67 that extends through hole 65 of pivotal base 69. A threaded end of bolt 67 mates with the threads of hole 57, as indicated by dotted line 59. The head 67' of bolt 67 receives a hex wrench, and recedes into countersunk mouth 65' of hole 65.

Holes 55 in stationary plate 53 are arranged in an arc, and pivotal base 69 can be pivoted in the direction indicated by arrow 97 (FIG. 4) so that a slightly tapered precision end 63' (FIG. 7) of spring loaded pin 63 can be aligned with a selected one of holes 55 and precisely tightly inserted therein. To understand this more clearly, FIG. 7, which shows a section view along section line 7—7 of FIG. 5, shows that pin 63 has a Tee handle 63'', and is biased or urged inward in the direction indicated by arrow 117 by a compressed coil spring 113, which presses in the direction of arrow 117 against a flange 100 of pin 63. The user can remove pin 63 from a selected one of precision holes 55 by pulling outward on Tee handle 63''. Nut 115 has a precision hole 115A therein through which pin 63 slides and receives a reaction force from one end of compressed spring 113.

A slide arm is disposed in a hole 103 located in the lower end of pivotal base 69, as shown in FIGS. 4–6. A rack and pinion assembly 127 attached to the left lower end of pivotal base 69 as shown in FIG. 4 causes slide arm 99 to move in or out of opening 103 in response to rotation of arm 73', in the direction indicated by arc 97 of FIG. 4. This causes pinion gear 123 (FIG. 6) to rotate in a direction indicated by arrow 125. Corresponding teeth mating with the teeth 121 of gear 123 are disposed in slide arm 99, causing it to move outward in a direction indicated by arrow 119 in FIG. 6. By rotating handle 73' by means of handle 75 in the direction opposite to arrow 97, slide arm 99 can move in the direction opposite to arrow 119.

The above-mentioned diamond dressing stone 15 is securely mounted on the outer end of precision cylindrical elongated rod or head 77 which slidably moves in and out of a hole 101 transversely disposed in the lower end of slide arm 99. The elongated head 77 moves perpendicularly to the direction of dashed line 91, which is shown along an element (geometrical definition) of the conical tip 19' of dressing stone 19, which is supported on tool holder 21, as shown in FIG. 4. A micrometer adjustment including a knurled knob 83, a threaded shaft 85, and a lock nut 87 are used to adjust the position of diamond dressing stone 15 along a line perpendicular to dashed line 91 and in a direction indicated by arrow 95 in order to determine the amount of material to be removed from lapping stone 19 during a dressing operation.

As best seen in FIGS. 4 and 5, and in accordance with an important aspect of the present invention, flat surface 53A of support plate 53 is in intimate contact with flat surface 68A of pivot base 69. The axis of pivot bolt 67 is precisely perpendicular to a plane in which a longitudinal axis of elongated head 77 and a symmetrical axis of lapping stone 19 both lie. Thus, when both handle 75 and arm 73' are rotated and when micrometer adjustment 83, 85, 87 is deployed, all movement of diamond dressing stone 15 is confined to the plane in which those two axis lie. Furthermore, when Tee handle 63'' is pulled outward to pivot base 69 in the direction indicated by arrow 60 in FIG. 4, motion of dressing stone 15 continues to be confined to that plane.

The above-described lapping machine thus can be made using easily performed machining techniques to ensure that dressing stone 15 always lies in the plane of the symmetrical axis of lapping stone 19. The tapered end 63' of spring loaded pin 63 and the mating flat surfaces 53A and 68A of support plate 53 and pivotal base 69, respectively, ensure that the dressing stone will always return to precisely the same position to accomplish precise, repeatable dressing of a particular lapping stone with a particular cone angle.

Provision of precision machined between-centers-ground steel column 5 avoids inaccuracy that is prone to occur if a cast iron column were utilized (as is the case for the prior art), since its temperature changes can result at least a slight distortion of the axis of symmetry of the dead center cone 11. Providing of a continuously variable speed spindle drive mechanism and providing instantaneous readout of spindle speed allows the operator to quickly adjust the spindle speed to obtain optimum rapid dressing or center lapping operations, avoiding the need to carry out the time consuming process of changing belts to attain different spindle speeds that might be suitable for those two operations, respectively.

The described embodiment of the invention facilitates sufficiently accurate center lapping that a maximum center line deviation of eight ten-thousandths of an inch can be achieved on a twenty-four inch long workpiece of sufficiently large diameter to ensure that no flexing of the workpiece occurs.

While the invention has been described with reference to a particular embodiment thereof, those skilled in the art will be able to make various modifications to the disclosed structure and method without departing from the true spirit and scope of the invention.

What is claimed is:

1. An improved center lapping machine comprising in combination:

(a) spindle means for supporting a rotary lapping element having an abrasive cone, said spindle means being movable along an axis of said abrasive cone to effect center lapping of a first center hole in a first end of a workpiece, said workpiece having a second end and a second center hole in said second end, and spindle rotating means for supporting said spindle means;

(b) variable speed motor means for applying variable speed rotary motion directly to said spindle means without necessitating changing drive belts in order to change spindle speed;

(c) stationary dead center cone means disposed in fixed aligned relationship to said abrasive cone for engaging said second center hole to effect accurate alignment of said workpiece with said abrasive cone during center lapping of said first center hole, an axis of said dead center cone means being colinear with said axis of said abrasive cone;

(d) a dressing stone element for precision dressing of said abrasive cone;

(e) dressing stone control means for precisely moving said dressing stone along a predetermined path in a fixed plane during a dressing operation to remove a thin layer of material from said dressing stone, and for moving said dressing stone away from said abrasive cone to a standby position, said axes of said abrasive cone and said dead center cone lying in said fixed plane, said dressing stone control means confining movement of said dressing stone element to said fixed plane both during said dressing operation and during movement of said dressing stone away from said conical abrasive stone element to said standby position that permits positioning of said workpiece during a center lapping of said first and second center holes, said dressing stone control means including (i) a stationary member having a first flat surface, (ii) a pivotal member having a second flat surface, (iii) pivot pin means for pivotally connecting said pivotal member to said stationary member, said second flat surface being in sliding relationship with said first flat surface during pivoting of said pivotal member, said first and second flat surfaces being parallel to said fixed plane, wherein said pivotal member includes a movable pin, and said stationary member includes at least one hole in said first flat surface for receiving an end portion of said movable pin to precisely lock said pivotal member into a position that corresponds to a cone angle of said abrasive cone during a center lapping operation, wherein during a dressing operation said movable arm means moves in a direction that is precisely parallel to a straight line that lies entirely on the surface of said abrasive cone and also lies in said fixed plane, said dressing stone thereby also moving parallel to said straight line during that dressing operation, wherein said movable pin is spring biased to continually urge said end portion into one of said holes in said first flat surface and includes a tee handle to facilitate manual pulling of said movable pin out of either of said holes in said first flat surface to permit pivoting of said pivotal member, wherein said end portion of said movable pin is slightly tapered from an extreme end poriton that is slightly smaller than mouths of said holes in said first flat surface to another portion that is slightly larger than mouths of said holes in said first flat surface so that said end portion of said movable pin always fits very closely in said holes in said first flat surface despite any wear of said end portion or of walls of said holes in said first flat surface, thereby ensuring a long life during which precisely repeatable accuracy in dressing operation can be achieved, (iv) first precision adjustment means for effecting precision adjustment of the position of said diamond to determine an amount of material to be removed from said conical abrasive lapping stone element during a dressing operation, and (v) movable arm means connected in movable relationship to said pivotal member for supporting said precision adjustment means and confining movement of said diamond to said fixed plane during a dressing operation; and (f) means for rigidly attaching said dressing stone control means directly to said spindle supporting means in order to prevent relative movement between said spindle and said dressing stone control means.

2. The improved center lapping machine of claim 1 including two of said holes in said first flat surface, one corresponding to an abrasive cone angle of 60 degrees and one corresponding to an abrasive cone angle of 45 degrees.

3. An improved method for center lapping first and second center holes in first and second ends, respectively, of a metal workpiece, said method comprising the steps of:

(a) moving a dressing stone to a first position near an abrasive cone while said abrasive cone rotates by pivoting a mechanism attached rigidly and directly to a spindle supporting means for supporting said abrasive cone and supporting said dressing stone about a fixed axis, said moving including confining movement of a point of said dressing stone to a fixed plane in which a symmetrical axis of said rotating abrasive cone lies, said moving including sliding a flat surface of said mechanism against a stationary flat surface of a fixed support, said flat surface of said machanism and said stationary flat surface being parallel to said fixed plane;

(b) adjusting the speed of rotation of said abrasive cone without changing any drive belts by adjusting the speed of a variable speed motor and causing said variable speed motor to rotate said abrasive cone;

(c) inserting a movable indexing element attached to said mechanism into an indexing opening in said fixed support to accurately lock said mechanism, the location of said opening corresponding to a cone angle of said abrasive cone element, said movable indexing element having a slightly tapered outer end portion to cause said tapered out end portion to always fit very closely in said indexing opening despite wear of said tapered end portion and said indexing opening:

(d) spring biasing said movable indexing element to maintain its close fit in said indexing opening during said center lapping;

(e) dressing said rotating abrasive cone element by moving said dressing stone along a straight line in said fixed plane so that said dressing stone causes removal of a thin layer of surface material from said abrasive cone element to improve the geometric preciseness thereof, to produce a dressed abrasive cone element;

(f) removing said indexing element from said indexing opening; and (g) moving said dressing stone away from the dressed abrasive cone element to permit center lapping of a center hole in a workpiece by means of said rotating abrasive cone element, said moving of said dressing stone confining a point of said dressing stone to said fixed plane, said flat surface of said mechanism continuing to slide against said stationary flat surface during said moving of said dressing stone away from said rotating abrasive cone element.

* * * * *